United States Patent [19]

Almen

[11] Patent Number: 4,688,353

[45] Date of Patent: Aug. 25, 1987

[54] GUARD ATTACHMENT FOR VEHICLE DOOR

[76] Inventor: Daniel V. Almen, 11800 - 27th Ave. North, Minneapolis, Minn. 55441

[21] Appl. No.: 871,680

[22] Filed: Jun. 9, 1986

[51] Int. Cl.[4] ..... E06B 3/30

[52] U.S. Cl. ..... 49/460; 16/1 R; 296/152; 280/770

[58] Field of Search ..... 49/460; 16/1 R, DIG. 2; 296/152, 1 R; D8/350, 352; D12/190; 280/770

[56] References Cited

U.S. PATENT DOCUMENTS

| | | | |
|---|---|---|---|
| 2,683,889 | 7/1954 | Kanocz | 49/460 X |
| 2,733,474 | 2/1956 | Capitani | 49/460 X |

OTHER PUBLICATIONS

J. C. Whitney & Co., catalog No. 448B, Parts and Accessories, p. 243.

*Primary Examiner*—Kenneth Downey
*Attorney, Agent, or Firm*—Herman H. Bains

[57] ABSTRACT

A guard device or shield for use with an automobile door is comprised of a rigid plastic material and is shaped to conform to the exterior door handle well. The shield is provided with at least one tab for securing the shield to the exterior panel of the automobile door to cover the exterior door handle well. Sealing elements are secured to the periphery of the shield and to the exterior door panel to provide seals thereat.

1 Claim, 8 Drawing Figures

GUARD ATTACHMENT FOR VEHICLE DOOR

This invention relates to an automotive vehicle attachment and, more particularly, to a guard attachment for a vehicle door.

BACKGROUND OF THE INVENTION

One of the exterior area portions of automobiles which is subject to extensive wear is the area surrounding an exterior door handle. In most vehicles, this exterior door area is a generally circular, ellipsoid, or generally semi-circular area and is sunken or concaved to permit a user to actuate the latch release when opening the door. Repeated manipulation of the latch release causes scratching and damage of the exterior door handle area. This damage regularly occurs, even though new resistant-type paints and coatings have been developed.

SUMMARY OF THE INVENTION

It is an object of this invention to provide a novel guard device, of simple and inexpensive construction, which may be readily attached to an automobile door adjacent the exterior handle thereof for protecting the surface against damage.

Another object of this invention is to provide a novel guard device, which is readily secured by attachment elements to an automobile door adjacent the exterior handle thereof, and which not only protects the surface against damage, but also enhances the appearance of the door.

These and other objects will be more fully defined in the following specification.

FIGURES OF THE DRAWING

DESCRIPTION OF THE PREFERRED EMBODIMENT

Figure 1:
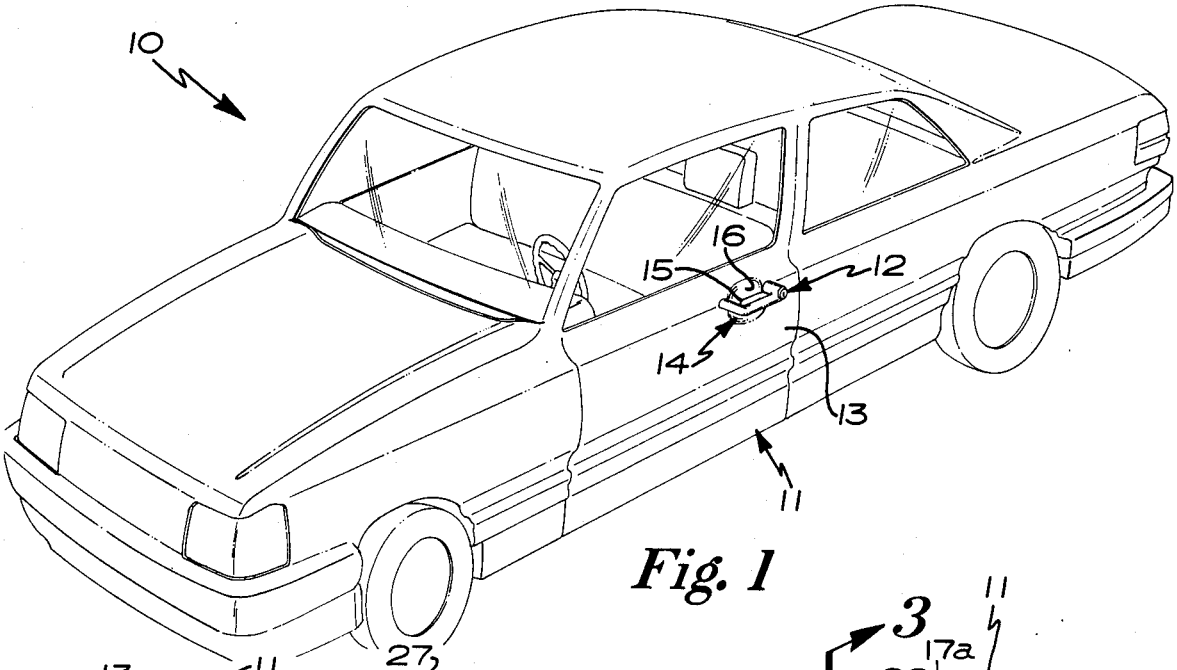
FIG. 1 is a perspective view of an automobile employing a novel guard device.

Referring now to the drawings and, more specifically, to FIG. 1, it will be seen that an automobile 10, representing a commercial type, is provided with a conventional door 11 having a U-shaped exterior handle 12 for use in opening and closing the door. The door 11 includes an external panel 13, which is formed of a suitable gauge steel. It is pointed out that the other details of construction of the door, including the inner panel and the various internal mechanisms, do not constitute part of the present invention and, therefore, do not require description. The generally U-shaped horizontally disposed exterior handle 12 is secured to the external panel 13 of the door 11 by suitable bolts or the like, and the U-shaped handle supports the latch release 15. The latch release 15 is connected by suitable linkage (not shown) to the door latch to permit opening of the door by a user from the outside.

The U-shaped handle 12 extends across a well or depression 14, which is of generally oval configuration, and which presents an outer concave surface 16. This door well facilitates access to the latch release by a user in a well-known manner. It is during the manipulation of the latch release that the concave surface 16 defining the well 14 becomes scratched and damaged by users. The novel guard device or shield, designated generally by the reference numeral 17, is provided for protecting the concave surface 16 of the well 14 against damage during manipulation of the latch release 15.

The guard device 17 is formed of a suitable rigid plastic material, and is of concavo-convex oval configuration. However, it is pointed out that the particular oval configuration illustrated in FIGS. 1–4 is especially adapted for use in an Audi Model 4000 automobile. It is further pointed out that the particular configuration of the guard device 17 may be modified to conform to other model automobiles having a handle well 14 in a slightly different configuration, as will be described more fully hereinbelow. The guard device 17 is formed of any suitable rigid plastic material, such as ABC plastic, and includes an inner convex surface 18, an outer concave surface 19, and a pair of laterally projecting tabs 20. Although the peripheral edge 17*a* of the guard device is continuous, it will be noted that the tabs 20 project in opposite directions from end portions 17*b* thereof.

Figure 3:
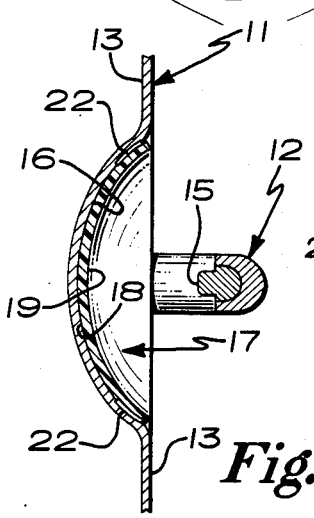
FIG. 3 is a cross-sectional view taken approximately along the line 3—3 of FIG. 2 and looking in the direction of the arrows.
Figure 2:
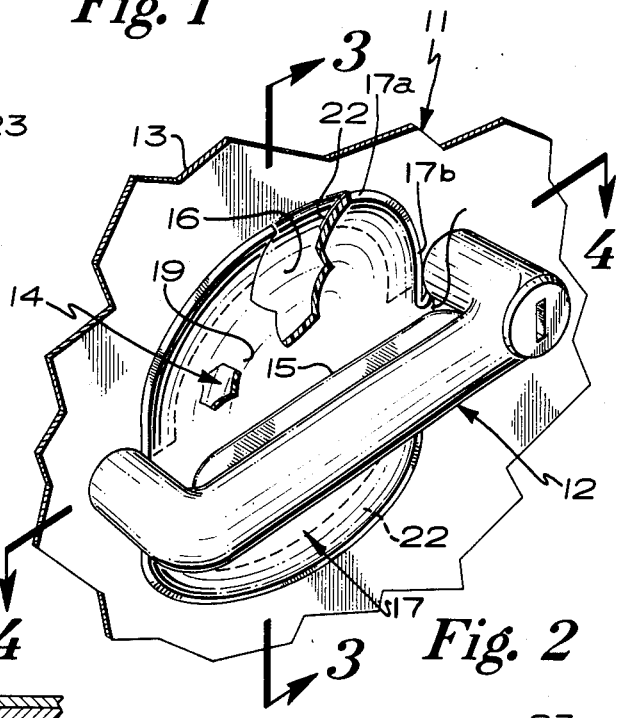
FIG. 2 is an enlarged fragmentary perspective view of a portion of an automobile door illustrating the novel guard device.
Figure 4:
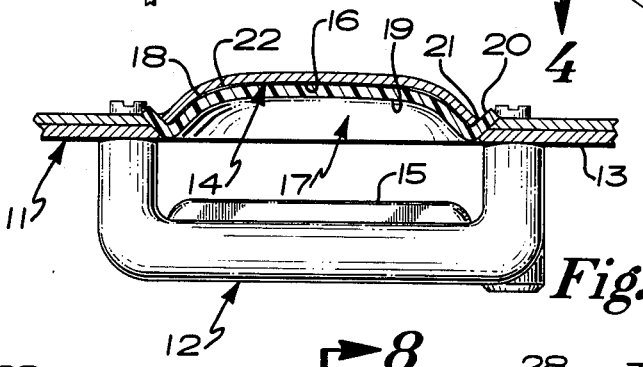
FIG. 4 is a cross-sectional view taken approximately along the line 4—4 of FIG. 2 and looking in the direction of the arrows.

The guard device may be readily applied to the exterior surface of the door 11 by merely inserting the tabs 20 into openings 21 in the exterior panel through which the legs 12*a* of the U-shaped handle project, as best seen in FIG. 4. The guard device 17 also has a pair of adhesive strips 22 affixed to the upper and lower edge portions thereof, as best seen in FIG. 3. These tape strips are formed of double-face isopolymer tape, such as that sold by Minnesota Mining. These tape strips extend in arcuate fashion, as best seen in FIG. 2, and provide a liquid seal to prevent water from seeping behind the guard device 17. Further, the tape strips also assist in securing the guard device to the exterior door panel.

The guard devices may be applied to all the doors of an automobile, and they provide an effective shield against damage to the handle well area. Further, the guard devices may be molded in various colors so that they may be used in harmony with various automobiles of different colors. It has been found that the guard devices not only provide an effective shield against damage, but also enhance the appearance of the automobiles.

Figure 6:
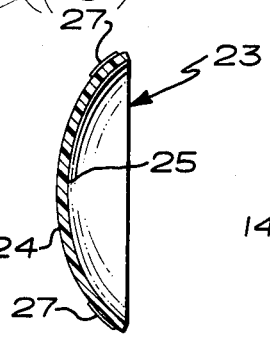
FIG. 6 is a cross-sectional view taken approximately along the line 6—6 of FIG. 5 and looking in the direction of the arrows.
Figure 5:
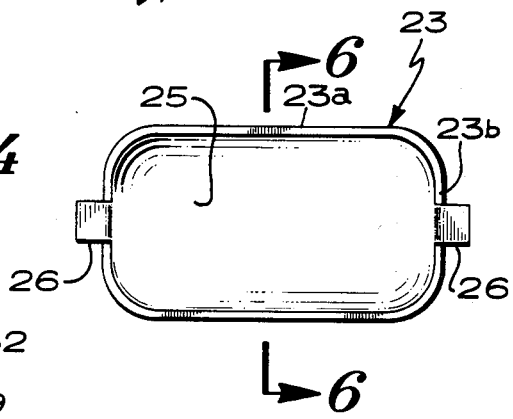
FIG. 5 is a front elevational view illustrating a different embodiment of the guard device.

Referring now to FIGS. 5 and 6, it will be seen that a slightly different embodiment of the guard device or shield is thereshown and is designated generally by the reference numeral 23. The shield is of concavo-convex generally elongate rectangular shape, but having arcuate rather than square corners. The peripheral edge of the guard device 23 includes a longitudinal edge portion 23*a* and end edge portions 23*b*, as best seen in FIG. 5.

The guard device 23 includes an inner convex surface 24, an outer convex surface 25, and laterally projecting tabs 26, which project from the mid-portions of the end edge portions 23*b* thereof, as best seen in FIG. 5. The particular model illustrated in FIG. 5 is for the Audi Model 5000 line, and is provided with a pair of elongate tape strips 27 that are of arcuate configuration and are applied in generally the same manner as the tape strips 22. The guard device 23 is secured to the exterior panel against the exterior surface defining the door well in substantially the same manner as the guard device 17.

Figure 7:
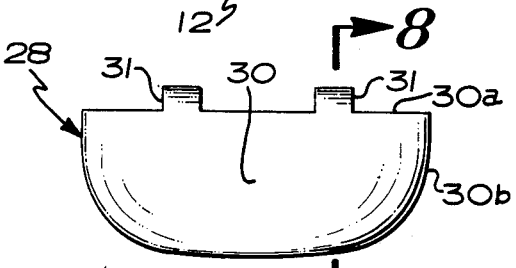
FIG. 7 is a fragmentary view of a different embodiment of the novel guard device applied to the exterior door of a different model automobile.
Figure 8:
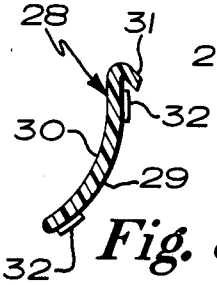
FIG. 8 is a cross-sectional view taken approximately along the line 8—8 of FIG. 7 and looking in the direction of the arrows.

Referring now to FIGS. 7 and 8, it will seen that a further embodiment of the guard device is thereshown and is designated generally by the reference numeral 28. The particular guard device 28 is adapted for use with a Honda Civic type automobile and is also of concavo-convex, generally elongate configuration. The guard device illustrated in FIGS. 7 and 8 is also formed of a rigid plastic material and includes an inner convex surface 29 and an outer convex surface 30. The peripheral edge of the guard device includes a continuous generally arcuate edge portion 30*a* and a substantially straight edge portion 30*b*. A pair of spaced apart tabs 31 are integral with the guard device and project from the upper straight edge portion 30*b* thereof. These tabs are adapted to extend through the openings in the outer panel of the door of a Honda Civic, through which the handle thereof projects. Again, it is pointed out that the guard device 28 is positioned in a concave well surface area for the door handle and is provided with a pair of tape strips 32 on the convex inner surface thereof, in the manner of the embodiments of FIGS. 1–6. All of the above-mentioned embodiments of the guard device do not interfere in any way with manipulation of the latch release, but do provide an effective guard to preclude damage to the handle well area of the external surface of the door. The various guard devices can be easily applied with a minimum amount of effort and tools.

Similar guard devices may be provided for various model cars, including the VW Jetta and the VW Golf. In these particular models, the tabs will project from the ends in the manner of the embodiments of FIGS. 1–6, and the tabs may be provided with slots to permit the tabs to clear the locking mechanisms. For example, the guard devices for use with Mercedes Models 190*e*, 190*d*, 300*e*, and 300*d*, will require that the tabs, which project from the ends of the guard device, fit behind the handle portions and the gasket that is associated therewith.

The Saab Model 900, 900S, and 900 Turbo will be generally similar to the embodiment of FIG. 5, but somewhat more ellipsoid, and will be provided with a tab at one end thereof and an opening in the other end thereof. The tab will be inserted into the opening in the exterior panel for the handle, and the other end portion of the guard device will be secured by a suitable screw from the inside.

Although the foregoing is only a brief description and is illustrative of the modified forms for other models, it will be pointed out that the guard device may be applied to most newer model automobiles. It is further pointed out that the guard device may be sold as an after-market item and easily retrofitted to any model.

Thus, it will be seen that I have provided a novel guard device for use in conjunction with the exterior door handle of an automobile door which not only is of simple and inexpensive construction, but one which functions in a more efficient manner than any heretofore known comparable device.

What is claimed is:

1. In combination with an automobile door having an exterior panel and an exterior door handle projecting through openings in the exterior panel, an inwardly concave door well in the exterior door panel adjacent the exterior door handle and defining a space behind the handle to permit insertion of a user's hand behind the handle to actuate the door latch release thereof, an imperforate concavo-convex generally oval-shaped shield having arcuate corner portions and being formed of a rigid plastic material and corresponding in size to the door well, said shield having a convex surface engaging the concave surface of the door well and presenting an exterior concave surface, a pair of spaced apart tabs integral with said shield at ends thereof and each tab projecting from one end edge of said shield, each tab being inserted into one of the openings in the exterior panel of the door without requiring removal of the door handle for securing the shield to the exterior handle so that the shield covers at least a portion of the door handle well, and adhesive sealing elements secured to the peripheral convex surface portions of the shield and to the exterior panel of the door, said tabs and said sealing elements comprising the sole means for securing the shield to the exterior panel defining the door handle well whereby said shield provides a protective ornamental cover thereat.

* * * * *